US010753292B2

(12) United States Patent
Noh et al.

(10) Patent No.: US 10,753,292 B2
(45) Date of Patent: Aug. 25, 2020

(54) METHOD AND DEVICE FOR CONTROLLING ENGINE DURING IDLE PURGE OF CANISTER

(71) Applicants: Hyundai Motor Company, Seoul (KR); Kia Motors Corporation, Seoul (KR)

(72) Inventors: Tae-Gon Noh, Busan (KR); Byung-Hoon Cho, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 143 days.

(21) Appl. No.: 15/838,706

(22) Filed: Dec. 12, 2017

(65) Prior Publication Data

US 2019/0112993 A1 Apr. 18, 2019

(30) Foreign Application Priority Data

Oct. 16, 2017 (KR) ..... 10-2017-0133963

(51) Int. Cl.
*F02D 41/00* (2006.01)
*F02M 25/08* (2006.01)
*F02D 41/08* (2006.01)

(52) U.S. Cl.
CPC ..... *F02D 41/0032* (2013.01); *F02D 41/0045* (2013.01); *F02D 41/08* (2013.01); *F02M 25/08* (2013.01); *F02D 41/0042* (2013.01); *F02D 2250/21* (2013.01); *F02D 2250/22* (2013.01)

(58) Field of Classification Search
CPC .. F02D 41/0032; F02D 41/0045; F02D 41/08; F02D 41/0042; F02D 41/004; F02M 25/08
USPC ..... 123/568.16, 568.18, 568.19, 568.2; 73/114.39
See application file for complete search history.

(56) References Cited

U.S. PATENT DOCUMENTS 5,404,862 A * 4/1995 Ohta ..... F02D 41/0045 123/698

FOREIGN PATENT DOCUMENTS

KR 2004-0017635 A 2/2004

* cited by examiner

*Primary Examiner* — Hai H Huynh
*Assistant Examiner* — Gonzalo Laguarda
(74) *Attorney, Agent, or Firm* — Mintz Levin Cohn Ferris Glovsky and Popeo, P.C.; Peter F. Corless

(57) ABSTRACT

A method of controlling an engine during idle purge of a canister includes: determining whether current operation information of a vehicle satisfies an idle purge condition, determining whether canister purge learning time performed during a part load condition is a set time or more when a purge operation condition is satisfied, and performing idle purge of the canister when the canister purge learning time performed during the part load condition is the set time or more.

10 Claims, 7 Drawing Sheets

METHOD AND DEVICE FOR CONTROLLING ENGINE DURING IDLE PURGE OF CANISTER

CROSS-REFERENCE(S) TO RELATED APPLICATION

This application claims under 35 U.S.C. § 119(a) the benefit of Korean Patent Application No. 10-2017-0133963, filed on Oct. 16, 2017, the entire contents of which are incorporated herein by reference.

BACKGROUND

(a) Field of the Disclosure

Exemplary embodiments of the present disclosure relate to a method and device for controlling an engine during idle purge of a canister, and more particularly, to a method and device for controlling an engine during idle purge of a canister, the method and device being different from engine control during a part load condition and being able to secure combustion stabilization under specific situations such as a purge concentration.

(b) Description of Related Art

In general, the purge amount of a canister has been increased by a maximum amount during idling and driving due to enhanced regulations on evaporation gas as required by governmental regulations.

A device and method for purge control of a canister in idling is disclosed in Korea Patent Application Publication No. 10-2004-0017635, published on Feb. 27, 2004. As disclosed in this published patent application, vehicles are designed to collect evaporation gas (HC) harmful to the human body and produced in a fuel tank and then supply the collected evaporation gas (HC) to an engine surge tank through a purge valve to send it to a combustion chamber.

Evaporation gas (HC) is mostly produced when fuel remaining in a fuel tank volatilizes, so it is important to collect the evaporation gas (HC) produced by the volatilization in a canister and prevent saturation of the canister by appropriately supplying the collected evaporation gas (HC) to an engine.

Under the applicable governmental regulations on evaporation gas (HC), control is performed to maximize the purging amount of a canister purge valve, that is, the opening ratio of a purge valve.

In order to control purge of evaporation gas (HC) collected in a canister as described above, the amount (concentration) of evaporation gas (HC) collected in the canister is determined by determining a feedback level of a fuel amount depending on the amount (concentration) of oxygen in exhaust gas detected by an oxygen sensor and then the opening ratio of a purge valve is determined, thereby performing control.

However, in a canister purge, the purge rate and the purge gas concentration may be incorrect, so manufacturers must cope with sudden disturbance due to purge gas supplied to an engine by increasing reserve torque for combustion stabilization.

SUMMARY

As described above, a torque controller for an engine is requested to increase reserve torque at every purge operation of a canister for combustion stabilization in the related art. However, it is preferable to minimize reserve torque for purposes of fuel efficiency rather than fuel control, or if necessary, to minimally use reserve torque.

Further, the reserve torque required during a part load condition with relatively a large amount of intake air and the reserve torque required in idling with a small amount of intake are not discriminated in the related art. However, it is required to selectively make the amount of reserve torque and whether to apply the reserve torque different, depending on the situation, in order to increase fuel efficiency.

For example, the following problems are generated when reserve torque is minimized to improve fuel efficiency.

FIG. 5 shows a phenomenon in which engine RPM rapidly drops from 700 RPM to 610 RPM when idle purge is finished before purge concentration learning is completed with high concentration of evaporation gas in a canister. In this state, a driver may be uncomfortable and, subsequently, the engine may be stopped.

In particular, the reason is that during rich fuel-air ratio control a purge valve is instantaneously closed due to dense purge gas, inflow of the dense purge gas is stopped, and engine RPM is fluctuated due to lean peak in a transient period in which the fuel-air ratio should be controlled only by injecting fuel through feedback from lambda sensor. In relation to this problem, there is a need to remove lean peak of fuel-air ratio through precise mapping, but there is a fundamental difference among purge valves, so there is a limit in dealing with the problem only by mapping.

FIG. 6 shows a phenomenon that RPM fluctuation is generated due to exceed fuel-air ratio during idle purge for evaporation gas leak diagnosis with high-concentration evaporation gas in a canister.

The RPM fluctuation of an engine is caused because the fuel-air ratio becomes excessively rich due to inflow of high-concentration purge gas during canister purging for evaporation gas leak diagnosis with high-concentration evaporation gas in a canister. In order to solve this problem, it is required to increase reserve torque or engine RPM, but a technical solution for this problem has not been proposed in the related art.

The present disclosure provides a method and device of controlling an engine which can remove an unstable state due to RPM fluctuation of the engine during idle purge and improve fuel efficiency.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with an embodiment of the present disclosure, a method of controlling an engine includes: determining whether current operation information of a vehicle satisfies an idle purge condition; determining whether canister purge learning time performed during a part load condition is a set time or more when a purge operation condition is satisfied; and performing idle purge of the canister when the canister purge learning time performed during the part load condition is the set time or more.

In accordance with another embodiment of the present disclosure, a method of controlling an engine during idle purge of a canister includes: determining whether current operation information of a vehicle satisfies an idle purge condition; performing idle purge of the canister when a purge operation condition is satisfied; determining whether diagnosis on whether fuel evaporation gas leaks is being performed; setting a reserve torque amount in accordance with whether diagnosis on whether fuel evaporation gas leaks is being performed; and requesting an engine torque control unit to secure the set reserve torque amount.

The method may further include: determining whether an idle purge finishing condition is satisfied; calculating an idle purge reduction rate when the idle purge is finished when the idle purge finishing condition is satisfied; and controlling closing of a purge valve in accordance with the calculated idle purge reduction rate when the idle purge is finished, in which the idle purge reduction rate is different from a purge reduction rate during the part load condition.

The method may further include: setting reserve torque for suppressing fluctuation of engine RPM when purge is finished, when a purge concentration learning time of the canister is less than a predetermined set time; and requesting the engine torque control unit to secure the set reserve torque amount when the idle purge is finished.

The method may further include: setting reserve torque for suppressing fluctuation of engine RPM when purge is finished, when an output value of lambda control comes out of a predetermined range; and requesting the engine torque control unit to secure the set reserve torque amount when the idle purge is finished.

The reserve torque amount set during the idle purge may be different from a reserve torque amount set when the idle purge is finished.

In accordance with still another embodiment of the present disclosure, a device of controlling an engine includes: a canister purge system collecting evaporation gas in a fuel tank, connected to an intake system of an engine through a purge valve, and purging the collected evaporation gas to the intake system of the engine; a operation information detection unit detecting an operation state of the engine; and a controller determining whether idle purge is performed and controlling the purge valve on the basis of operation information of a vehicle and purge concentration learning time of a canister, thereby controlling the canister purge system.

When current operation information of a vehicle satisfies an idle purge condition and the purge concentration learning time of the canister is a set time or more, the controller may open the purge valve to perform idle purge.

The device may further include an engine torque control unit, in which the controller, during purge, may determine whether diagnosis on whether fuel evaporation gas leaks is being performed, set a reserve torque amount on the basis of the determination result, and request the engine torque control unit to secure the set reserve torque amount.

The controller calculates an idle purge reduction rate when the idle purge is finished, and adjusting the closing amount of the purge valve in accordance with the calculated idle purge reduction rate, thereby finishing the idle purge.

When the concentration of evaporation gas in the canister is a predetermined level or more, the controller may set reserve torque for suppressing fluctuation of engine RPM when the purge is finished and request the engine torque control unit to secure the set reserve torque amount, and the reserve torque amount set during idle purge is different from the reserve torque amount set when the idle purge is finished.

The device may further include an oxygen sensor for detecting an oxygen concentration of exhaust gas, in which when an output value of a lambda control using the oxygen sensor comes out of a predetermined range, a reserve torque amount for suppressing fluctuation of engine RPM when purge is finished may be set, and the engine torque control unit may be requested to secure the set reserve torque amount.

According to the method and device of controlling an engine of the present disclosure, since engine RPM reduction when idle purge is stopped is removed, unpleasant feeling that a driver can feel due to noise and vibration is removed, so riding comfort and commercial quality of a vehicle are improved.

Further, according to the method and device of controlling engine, when learning of purge concentration is not completed in an idle high-concentration canister state, it is possible to selectively request additional purge reserve torque, so it is possible to reduce the amount of requested reserve torque in comparison to the reserve torque requested during common purge.

That is, simple control of increasing reserve torque was performed to stably control combustion during purge operation in the related art, but, according to the present disclosure, it is possible to increase a requested amount of torque only when there is a need for increasing purge reserve torque, but if not so, it is possible to minimize the requested amount of reserve torque, so it is possible to reduce the whole use of purge reserve torque while a vehicle is driven, whereby fuel efficiency can be improved.

DESCRIPTION OF SPECIFIC EMBODIMENTS

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, embodiments of the present disclosure will be described with reference to the accompanying drawings.

Figure 1:
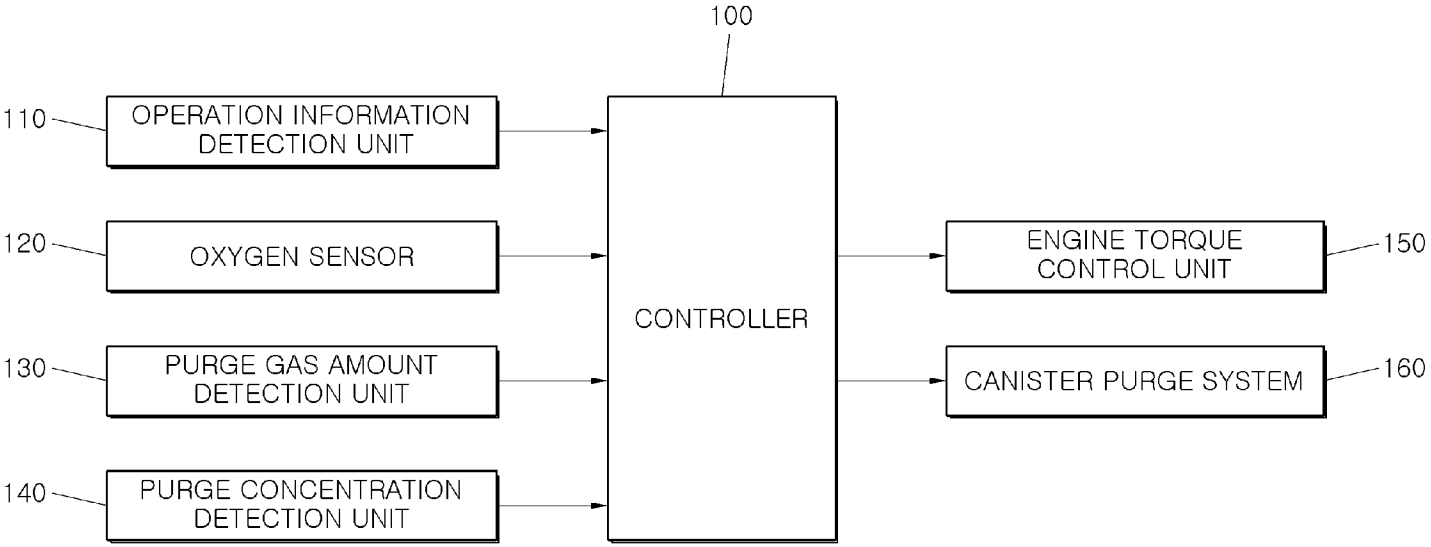
FIG. 1 is a block diagram showing the configuration of a device of controlling an engine according to an embodiment of the present disclosure.

FIG. 1 is a block diagram showing the configuration of a device of controlling engine according to an embodiment of the present disclosure.

First, an operation information detection unit 110 detects information about an operation state of an engine of a vehicle using various sensors and transmits the information to a controller 100. The operation information that is detected by the operation information detection unit 110 is information such as the coolant temperature for an engine, engine RPM, and engine load, which are factors that determine whether to start idle purge or determine the opening ratio of a purge valve during purge.

An oxygen sensor 120 is a component for measuring density of exhaust gas by detecting oxygen concentration of the exhaust gas. The oxygen sensor 120, which is usually disposed ahead of and behind a three-way catalyst, detects density of combustion by measuring oxygen concentration of exhaust gas and transmits the density to the controller 100.

A purge gas amount detection unit 130 detects the amount of purge gas flowing into an intake manifold when a purge gas valve (second valve 40 to be described below) is open. In detail, the purge gas amount detection unit 130 calculates a purge gas amount using the opening ratio of the purge gas valve and the pressure difference between a canister and the intake manifold.

A purge concentration detection unit 140 is a component for detecting the concentration of purge gas spread into an intake system of an engine from the canister purge system through a purge pipe. The purge concentration detection unit 140 measures the concentration of purge gas using a lambda value or the thick/thin degree of fuel-air ratio measured through the oxygen sensor during purge, and the controller 100 performs purge learning using the measurement result. For example, when the current purge learning value is 10, an HC amount corresponding to the value in a purge rate is subtracted from a fuel injection amount, in which exhaust gas measured by the oxygen sensor is rich, it means that the actual purge rate is higher than 10, so the learning value is adjusted (increased).

An engine torque control unit 150 is a component for securing reserve torque in response to a request from the controller 100. The engine torque control unit 150 adjusts the intake amount of the engine and ignition timing of the internal combustion engine on the basis of a reserve torque amount required for securing a reserve torque amount requested by the controller 100, and secures an increase in output torque due to an increase in intake amount as reserve torque.

The reserve torque secured by the engine torque control unit 150, as described below, is used to stabilize combustion by reducing fluctuation of the engine RPM during idle purge of the canister.

A canister purge system 160 is a unit that collects an HC (hydrocarbon component) in evaporation gas produced in a fuel tank and sends the collected purge gas to the intake system of the engine as much as the pressure difference between the intake manifold and the canister when the purge valve is opened.

Figure 4:
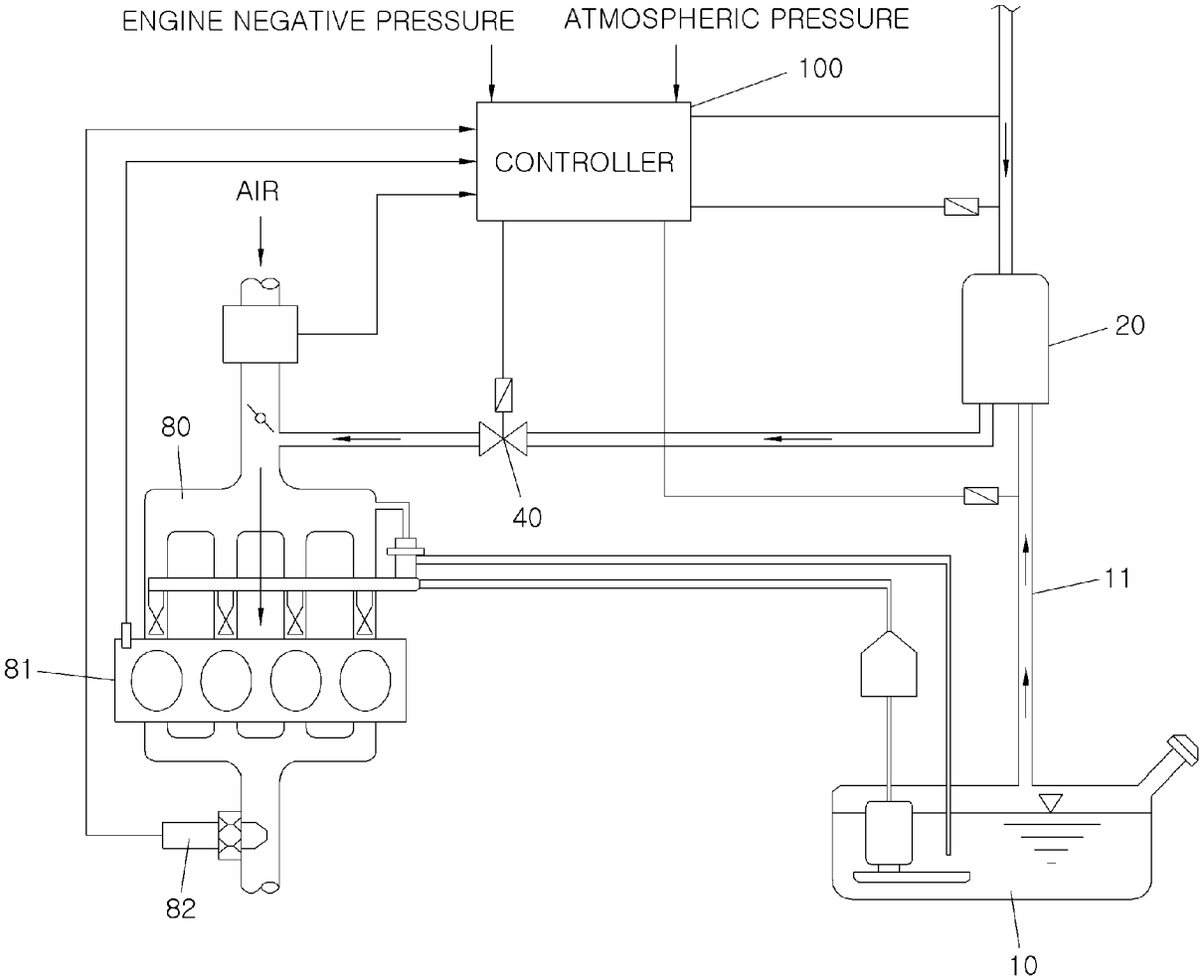
FIG. 4 is a view schematically showing the configuration of a canister purge system performing idle purge.

FIG. 4 shows a representative example of the canister purge system 160. Referring to FIG. 4, the canister purge system 160 includes a fuel tank 10, a canister 20, a first valve 30, a second valve 40, and an intake system 80.

The fuel tank 10 keeps volatile oil that is used as the fuel of a vehicle and the canister 20 purges and collecting evaporation gas produced through evaporation in the fuel tank 10 through a collection pipe 11.

The first valve 30, which is a canister check valve disposed in an atmosphere pipe, allows fresh air to flow into the canister 20 from the atmosphere by keeping open by the controller 100.

The first valve 30 is closed by the controller 100 when leak diagnosis is performed on the fuel system.

The second valve 40, which is a purge valve disposed in a purge pipe 21 connecting the canister 20 and the intake system 80 of the engine to each other, purges evaporation gas collected in the canister 20 to the intake system 80 of the engine or blocks the evaporation gas by being opened/closed by the controller 100.

The second valve 40 is opened by the controller 100 and purges the evaporation gas collected in the canister 20 to the intake system 80 of the engine under a purge condition, but it is closed by the controller 100 and stops the evaporation gas collected in the canister 200 from spreading into the intake system 80 of the engine not under the purge condition.

The first valve 30, second valve 40, and third valve 50 may be solenoid valve, and may be various types of valves, depending on design.

The controller 100 receives the information detected by the operation information detection unit 110, the oxygen sensor 120, the purge gas amount detection unit 13, and the purge concentration detection unit 140, and during idling, controls the canister purge system 160, calculates a reserve torque amount required for combustion stabilization, and requests the engine torque control unit 150 to secure reserve torque. The detailed control method that is performed by the controller 100 is described hereafter in detail with reference to FIGS. 2A and 2B.

Figure 2A:
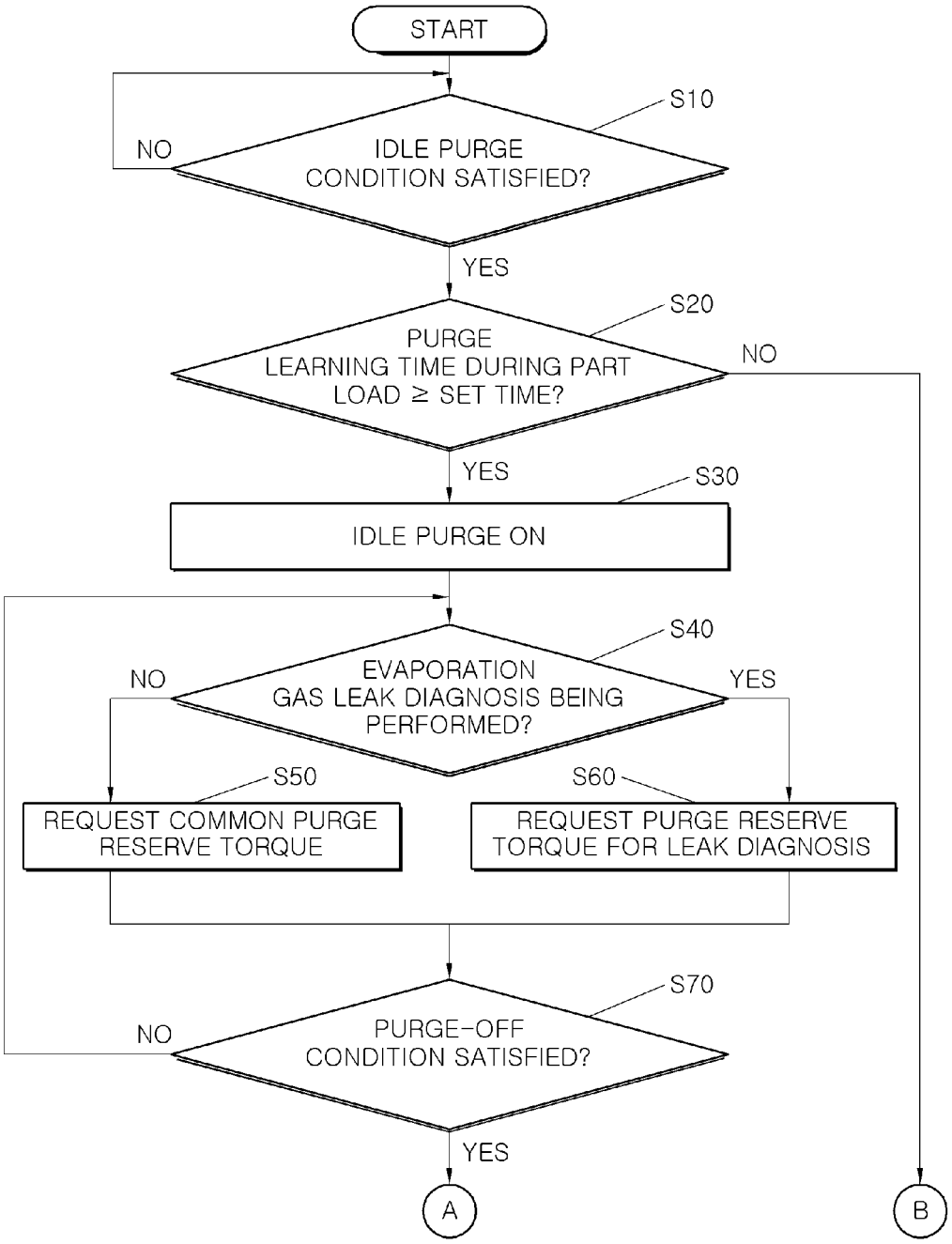
FIGS. 2A and 2B are flowcharts showing a method of controlling an engine according to an embodiment of the present disclosure.
Figure 2B:
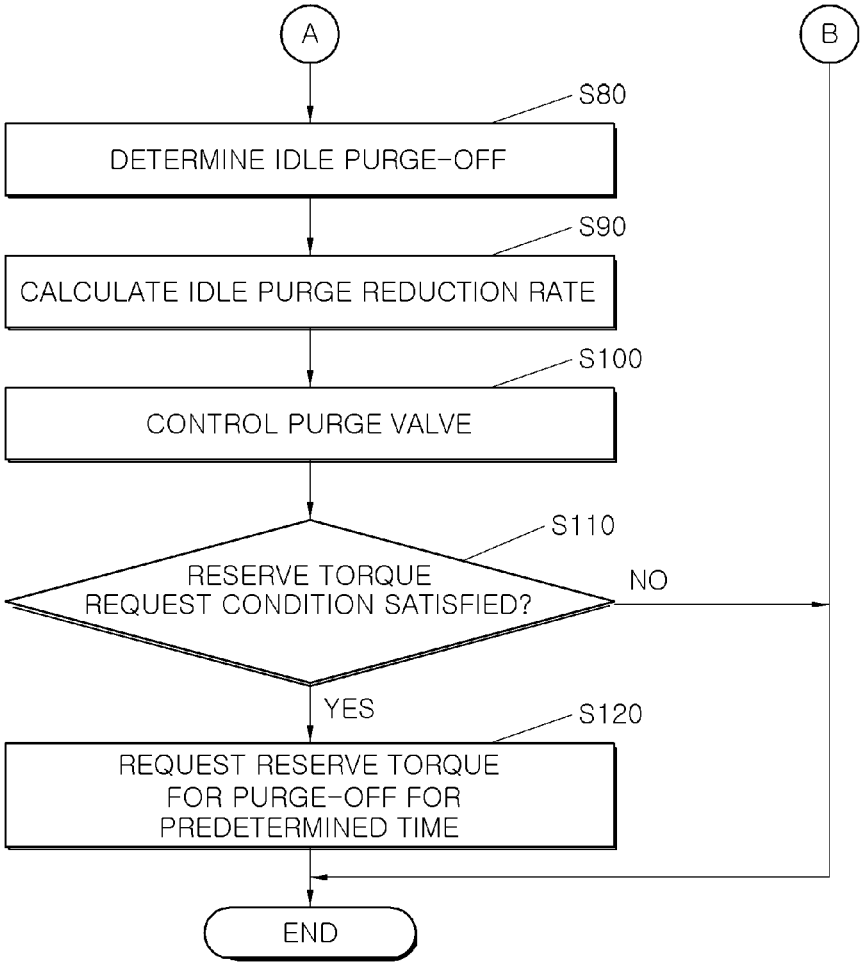

FIGS. 2A and 2B are flowcharts showing a method of controlling an engine according to an embodiment of the present disclosure.

Referring to FIGS. 2A and 2B, first, the controller 100 receives the current operation information of a vehicle from the operation information detection unit 110 and determines whether an idle purge condition is satisfied (S10).

That is, the controller 100 determines whether to start idle purge on the basis of the information from the operation information detection unit 110 on the basis of coolant temperature of an engine, engine RPM, intake air temperature, engine load, and an air amount and determines the opening ratio of the second valve (purge valve) 40 of the canister purge system 160 required for idle purge on the basis of the corresponding information.

Next, the controller 100 opens the second valve 40 on the basis of the calculated opening ratio, and before performing purge to the intake system of the engine, checks learning time of purge concentration during a part load condition before an idle state and then compares the learning time with a predetermined set time (S20).

It has been determined through experimentation that as purge concentration learning was performed during part load under the same conditions, the lean peak of a fuel-air ratio was reduced and a decrease in engine RPM was reduced after purge was finished.

Figure 3:
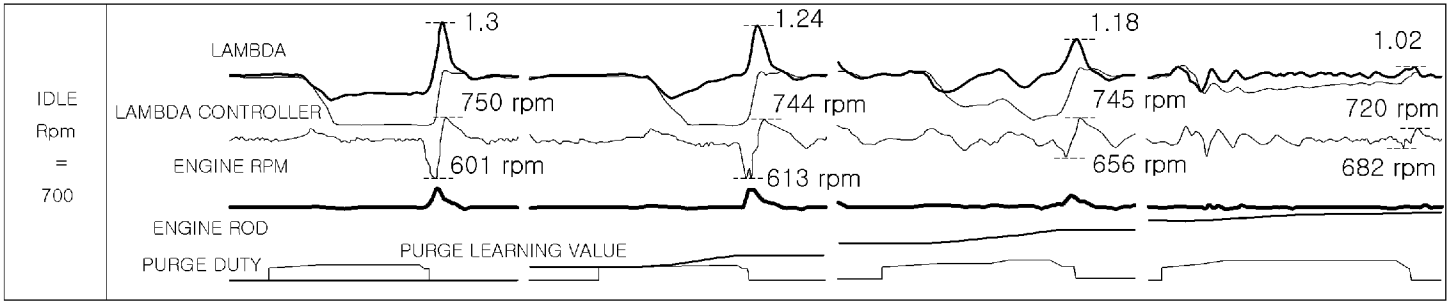
FIG. 3 is a signal diagram showing a change in engine RPM during idle purge when the method of controlling an engine according to an embodiment of the present disclosure is applied.

The result is shown in FIG. 3. As shown in FIG. 3, it can be seen that as the learning time of purge concentration passes, the lean peak of the purge fuel-air ratio when the purge is finished is reduced, and the RPM (682 RPM) of an engine almost come close to idle RPM (700 RPM).

Accordingly, the controller 100 is supposed to first determine whether the purge concentration learning time during a part load condition is a predetermined set time or more to be able to suppress reduction of the lean peak of a fuel-air ratio and the RPM of an engine (S20). If the purge concentration learning time during the part load condition is shorter than the predetermined set time, the controller 100 stops purge. In contrast, when the purge concentration learning time during the part load condition is the predetermined set time or more, a decrease in engine RPM is not large when purge is stopped, so the controller 100 controls the canister purge system 160 to perform idle purge.

Meanwhile, according to an embodiment of the present disclosure, the controller determines whether leak diagnosis of evaporation gas is being performed, when idle purge is performed.

The leak diagnosis of evaporation gas, which is a diagnosis for determining whether evaporation gas leaks from a fuel supply line including the fuel tank, is usually composed of measuring evaporation pressure, applying negative pressure to the fuel tank, standing by for a predetermined time with the negative pressure applied, and checking a leakage amount.

In the measuring of evaporation pressure, the second valve 40 and the first valve 30 of the canister purge system 160 are closed to measure the pressure value of natural evaporation gas in the fuel tank 10, which the value is a predetermined input value.

In the applying of negative pressure, the internal pressure of the fuel tank 10 becomes a predetermined set negative pressure by slowly opening the second valve 40.

In a stand-by state, after the internal pressure of the fuel tank 10 becomes the predetermined set negative pressure, the second valve 40 is closed until the internal pressure reaches target negative pressure.

In the checking of a leakage amount, whether evaporation gas leaks is determined using the slope of a pressure change until the target negative pressure is reached.

Figure 5:
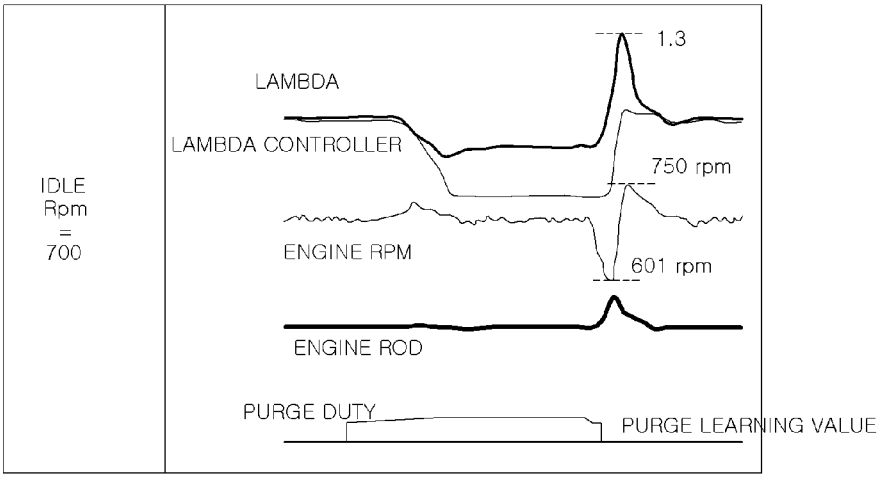
FIG. 5 is a signal diagram showing a rapid drop of engine RPM when idle purge is finished before purge concentration learning is completed when concentration of purge gas is high.
Figure 6:
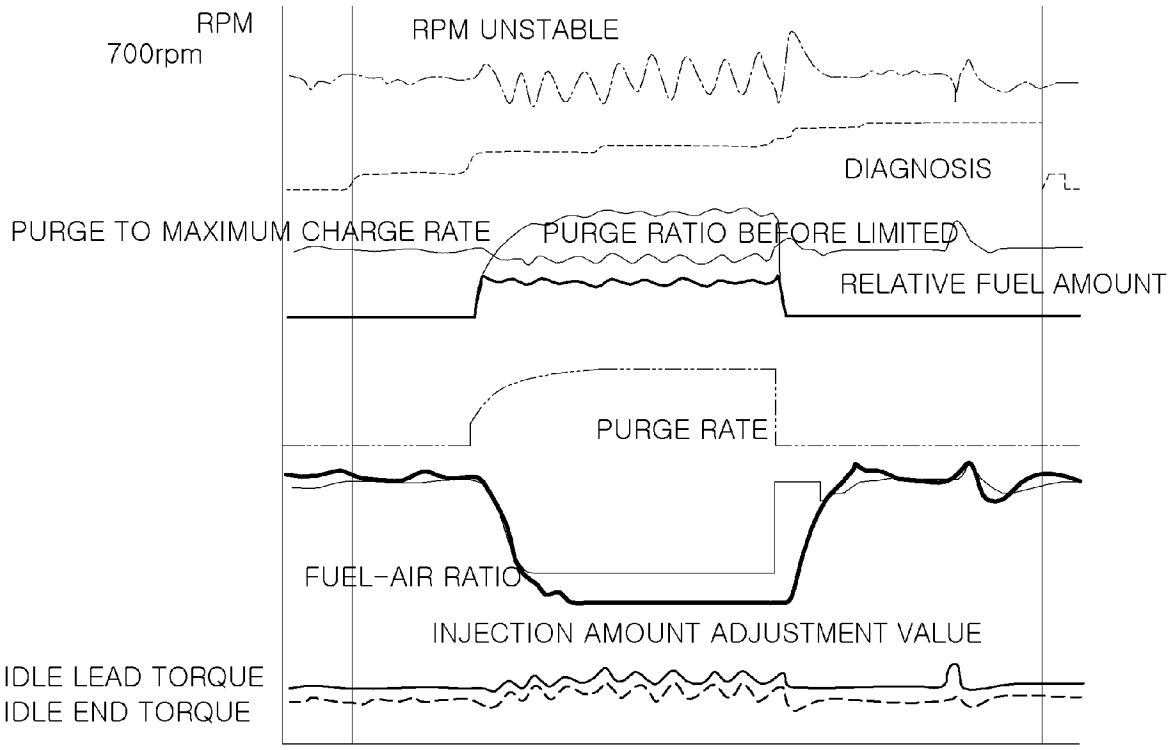
FIG. 6 is a signal diagram showing engine RPM fluctuation during idle purge for evaporation gas leak diagnosis when concentration of purge gas is high.

When idle purge is performed during leakage diagnosis of evaporation gas, high-concentration purge gas flows into the engine, so the fuel-gas ratio becomes excessively rich, thereby generating fluctuation of the engine RPM (see FIG. 5). Accordingly, as compared with idle purge when leakage diagnosis of evaporation gas is not performed, the fluctuation of the engine RPM by idle purge is increased, so it is required to secure more reserve torque.

Accordingly, when determining that idle purge is performed during leakage diagnosis of evaporation gas, the controller sets purge reserve torque for leakage diagnosis and requests the engine torque control unit 150 to secure the set reserve torque (S50). Further, when determining that leakage diagnosis of evaporation gas is not performed, the controller 100 sets a reserve torque amount for common idle purge and requests the engine torque control unit 150 to secure the set reserve torque (S50).

During a part load condition, large torque is generated due to a large amount of intake air, so large reserve torque is not required, but small torque is generated due to a small amount of intake air in idle, so it is vulnerable to sudden disturbance (for example, operation of a wiper or a window). Accordingly, it is required to take precautions against this disturbance using reserve torque.

As described above, by discriminating reserve torque for a part load condition and idling, it is possible to stabilize combustion and improve fuel efficiency.

After starting idle purge, the controller 100 determines whether to finish the idle purge on the basis of the information detected by the operation information detection unit 110 (S70). Further, when finishing the idle purge on the basis of the detected information, the controller 100 calculates an idle purge reduction rate on the basis of the difference between a target lambda value and the actually controlled lambda value (S90). According to the present disclosure, the purge reduction rate is separately set during part and idle.

If the idle reduction rate is excessively large, the amount of high-concentration purge gas supplied to the intake system of the engine is rapidly decreased, which influences the engine RPM. Accordingly, it is required to set the purge reduction rate such that the purge rate is smoothly reduced when the idle purge is stopped in order to prevent problems with rapid purge rate reduction. Meanwhile, as described above, the amount of air is larger during a part load condition than during idling, so the influences due to the purge rate reduction are different. Accordingly, it is preferable to set the purge reduction rates different in the part load condition and the idling.

When idle purge reduction rate is determined, the controller 100 finishes the idle purge by gradually decreasing the opening ratio of the second valve 40 on the basis of the determined idle purge reduction rate (S100).

Meanwhile, as described above, when the second valve 40 is closed and inflow of purge gas is stopped, a transient period in which the fuel-air ratio should be controlled only injection through lambda sensor feedback, so there is a large possibility of lean peak of the fuel-air ratio in the period. Further, this problem becomes worse when the concentration of the evaporation gas in the canister is high or when the purge concentration learning has not been normally performed.

Therefore, according to an embodiment of the present disclosure, it is determined whether a predetermined condition is satisfied when the idle purge is stopped (S100), and when the condition is satisfied, the engine torque control unit 150 is requested to secure a predetermined magnitude of reserve torque to be able to prevent fluctuation of the engine RPM due to lean peak of the fuel-air ratio (S120).

In an embodiment of the present disclosure, the controller 100 requests reserve torque discriminated in accordance with the concentration of purge gas. When the purge concentration learning has not been normally performed despite excessive concentration of the purge gas, a lambda control value becomes a predetermined value or less, so, in this case, reserve torque different from that during purge is requested for a predetermined time after the purge is finished. The controller 100 sets the discriminated reserve torque and requests the engine torque control unit 150 to secure the discriminated reserve torque.

In another embodiment of the present disclosure, the purge concentration learning time of the engine canister purge system 160 is used as a condition for requesting security of reserve torque when idle purge is stopped. When the purge concentration learning is not normally performed, it is impossible to estimate the exact influence on the fuel-air ratio by the purge gas, so when the fuel-air ratio control is performed only by injection after the idle purge is stopped, there is a large possibility of fluctuation of the engine RPM.

Accordingly, when the purge concentration learning time of the canister is less than a set time, the controller 100 set reserve torque for suppressing fluctuation of the engine RPM and requests the engine torque control unit 150 to secure the reserve torque.

In another embodiment of the present disclosure, the output value of lambda control is used as a condition for requesting security of reserve torque when idle purge is stopped.

When the lambda control value using the oxygen sensor comes out of a predetermined set reference range, the fuel-air ratio control becomes unstable, so when the fuel-air ratio control is performed only by injection after the idle purge is stopped, there is a large possible of fluctuation of the engine RPM.

Accordingly, when the lambda control value comes out of the predetermined set reference range, the controller 100 set reserve torque for suppressing fluctuation of the engine RPM and requests the engine torque control unit 150 to secure the reserve torque.

Meanwhile, the reserve torque amount required for preventing a rapid change of the engine RPM during idle purge and the reserve torque amount required for preventing a rapid change of the engine RPM when the idle purge is stopped are different. Accordingly, in the embodiments of the present disclosure, the reserve torque amount set by the controller 100 is different from the reserve torque amount set during the idle purge.

According to the method and device of controlling engine according to an embodiment of the present disclosure, when learning of purge concentration is not completed in an idle high-concentration canister state, it is possible to selectively request additional purge reserve torque, so it is possible to reduce the amount of requested reserve torque in comparison to the reserve torque requested during common purge.

Further, when purge reserve torque is used to remove the problem of reduction of engine RPM with idle purge stopped, it is possible to increase a requested amount of torque only when there is a need for increasing purge reserve torque, but if not so, it is possible to minimize the requested amount of reserve torque, so it is possible to reduce the whole use of purge reserve torque while a vehicle is driven, whereby fuel efficiency can be improved.

The foregoing exemplary embodiments are only examples to allow a person having ordinary skill in the art to which the present disclosure pertains (hereinafter, referred to as those skilled in the art) to easily practice the present disclosure. Accordingly, the present disclosure is not limited to the foregoing exemplary embodiments and the accompanying drawings, and therefore, a scope of the present disclosure is not limited to the foregoing exemplary embodiments. Accordingly, it will be apparent to those skilled in the art that substitutions, modifications and variations can be made without departing from the spirit and scope of the disclosure as defined by the appended claims and can also belong to the scope of the present disclosure.

What is claimed is:

1. A method of controlling an engine during idle purge of a canister, the method comprising: determining, by a controller, whether current operation information of a vehicle satisfies an idle purge condition; performing, by the controller, purge of the canister during a part load condition; determining, by the controller, whether canister purge learning time, which is performed during the part load condition, is greater than or equal to a set time when a purge operation condition is satisfied; performing, by the controller, idle purge of the canister when the canister purge learning time performed during the part load condition is greater than or equal to the set time, wherein the idle purge is performed under an idle condition of less than 700 RPM without depressing an accelerator; determining whether an idle purge finishing condition is satisfied; calculating an idle purge reduction rate when the idle purge is finished when the idle purge finishing condition is satisfied; and controlling closing of a purge valve at the idle purge reduction rate when the idle purge is finished, wherein the idle purge reduction rate is different from a purge reduction rate during the part load condition.

2. The method of claim 1, further comprising:

setting reserve torque for suppressing fluctuation of engine RPM when purge is finished, when a purge concentration learning time of the canister is less than a predetermined set time; and requesting the engine torque control unit to secure the set reserve torque amount when the idle purge is finished.

3. The method of claim 1, further comprising:

setting reserve torque for suppressing fluctuation of engine RPM when purge is finished, when an output value of lambda control comes out of a predetermined range; and requesting the engine torque control unit to secure the set reserve torque amount when the idle purge is finished.

4. The method of claim 2, wherein the reserve torque amount set during the idle purge is different from a reserve torque amount set when the idle purge is finished.

5. The method of claim 2, wherein the reserve torque amount set when the idle purge is started is different from a reserve torque amount set when the idle purge is finished.

6. The method of claim 3, wherein the reserve torque amount set when the idle purge is started is different from a reserve torque amount set when the idle purge is finished.

7. A device of controlling an engine, the device comprising:

a canister purge system collecting evaporation gas in a fuel tank, connected to an intake system of an engine through a purge valve, and purging the collected evaporation gas to the intake system of the engine, wherein purge of a canister is performed during a part load condition; a operation information detection unit detecting an operation state of the engine; a controller determining whether idle purge is performed and controlling the purge valve on the basis of operation information of a vehicle and purge concentration learning time of the canister, thereby controlling the canister purge system; and the controller configured to open the purge valve and to perform the idle purge of the canister when current operation information of a vehicle satisfies an idle purge condition and the purge concentration learning time of the canister is greater than or equal to a set time, wherein the idle purge is performed under an idle condition of less than 700 RPM without depressing an accelerator, wherein the controller determines whether an idle purge finishing condition is satisfied, calculates an idle purge reduction rate when the idle purge is finished when the idle purge finishing condition is satisfied, and controls closing of the purge valve at the idle purge reduction rate when the idle purge is finished, and wherein the idle purge reduction rate is different from a purge reduction rate during the part load condition.

8. The device of claim 7, further comprising an engine torque control unit, wherein the controller, during purge, determines whether diagnosis on whether fuel evaporation gas leaks is being performed, sets a reserve torque amount on the basis of the determination result, and requests the engine torque control unit to secure the set reserve torque amount.

9. The device of claim 7, wherein the controller calculates an idle purge reduction rate when the idle purge is finished, and adjusting the closing amount of the purge valve in accordance with the calculated idle purge reduction rate, thereby finishing the idle purge.

10. The device of claim 8, further comprising an oxygen sensor for detecting an oxygen concentration of exhaust gas, wherein when an output value of a lambda control using the oxygen sensor comes out of a predetermined range, a reserve torque amount for suppressing fluctuation of engine RPM when purge is finished is set, and the engine torque control unit is requested to secure the set reserve torque amount.

* * * * *